US005156801A

United States Patent [19]

Rothrock, Jr.

[11] Patent Number: 5,156,801

[45] Date of Patent: Oct. 20, 1992

[54] LOW POROSITY-HIGH DENSITY RADIAL BURST REFRACTORY PLUG WITH CONSTANT FLOW

[75] Inventor: Russell W. Rothrock, Jr., Lombard, Ill.

[73] Assignee: Refractory Services Corp., East Chicago, Ind.

[21] Appl. No.: 744,108

[22] Filed: Aug. 13, 1991

Related U.S. Application Data

[63] Continuation-in-part of Ser. No. 532,585, Jun. 4, 1990, abandoned.

[51] Int. Cl.[5] ..... C21C 5/32

[52] U.S. Cl. ..... 266/225; 266/217; 266/265

[58] Field of Search ..... 266/220, 265, 225, 268, 266/217, 218; 222/603

[56] References Cited

U.S. PATENT DOCUMENTS

| | | | |
|---|---|---|---|
| 4,326,701 | 4/1982 | Hayden, Jr. et al. | 266/225 |
| 4,376,868 | 1/1983 | Bloom et al. | 266/225 |
| 4,535,975 | 8/1985 | Buhrmann et al. | 266/220 |
| 4,783,058 | 11/1988 | Peri | 266/225 |

FOREIGN PATENT DOCUMENTS

| | | | |
|---|---|---|---|
| 0297067 | 12/1988 | European Pat. Off. | 266/225 |

*Primary Examiner*—Scott Kastler

[57] ABSTRACT

Apparatus including a nozzle or refractory pipe lance for the secondary refinement of a bath of molten metal by the injection of a gas under pressure, having one or more low porosity-high density refractory plugs which contain apertures of constant diameter, at least those about the perimeter of the plugs having an arcuate shape. For the manufacture of a pipe lance, the lower porosity-high density refractory plugs are attached to a central tube. The low porosity-high density of the refractory plugs provides a corrosion resistance to any change in the diameter of the gas nozzles and thereby produces a controlled high velocity radial burst gas stream. Generating the radial burst of small bubbles and maintaining the gas velocity of a high constant rate reduces erosion of the refractory material around the tope of the apparatus and extends the lifetime of the pipe lance or nozzle. As progressive refractory wear proceeds during the useful life of the pipe lance, the gas flow rate will remain constant within a closed system.

14 Claims, 6 Drawing Sheets

FIG. 2
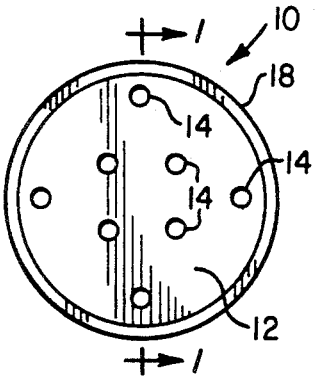
FIG. 1
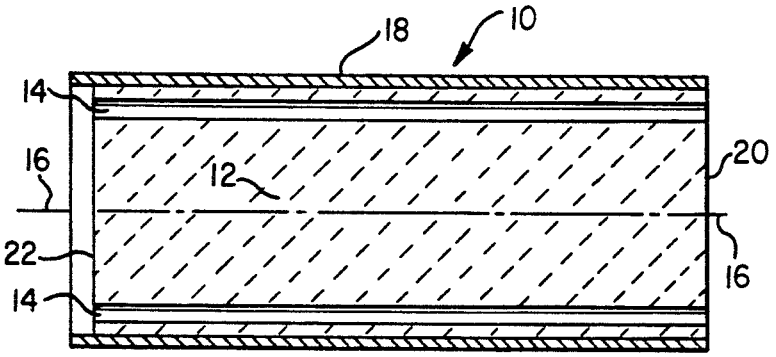
FIG. 3
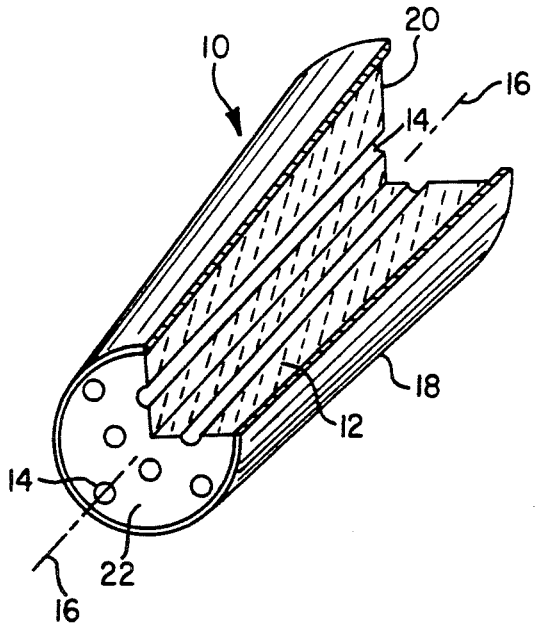
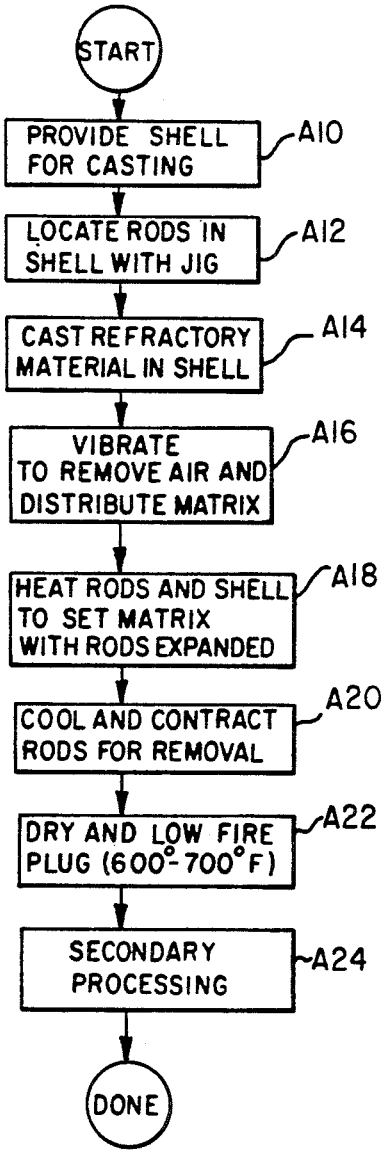
FIG. 4

LOW POROSITY-HIGH DENSITY RADIAL BURST REFRACTORY PLUG WITH CONSTANT FLOW

CROSS-REFERENCE TO RELATED APPLICATION

The instant application is a continuation in part of U.S. application Ser. No. 07/532,585 filed Jun. 4, 1990, now abandoned.

FIELD OF THE INVENTION

The invention pertains generally to apparatus used in metallurgical processes, e.g., pipe lances and nozzles for injecting gas into a molten metal, and more particularly to such apparatus which include low porosity-high density radial burst refractory plugs with constant flow characteristics.

BACKGROUND OF THE INVENTION

As is previously known, many metallurgical processes require the injection of an inert gas or gases, such as Argon, into a molten metal while the metal is being held within a refractory lined ladle. This provides a secondary treatment or refinement process prior to transporting the metal to a continous caster or teaming isle for casting into a solid shape. This secondary treatment, following decarburization of the liquid metal (the iron being converted into steel through removal of impurities in a basic oxygen furnace vessel, or other like converter), is accomplished by using an externally lined refractory pipe lance or other nozzle. Examples of pipe lances of this type are shown in U.S. Pat. No. 4,854,553 and U.S. Pat. No. 4,367,868.

A pipe lance produces bubbles by injecting the gas into the molten metal under pressure for a variety of purposes. The bubbling pipe lance serves the purposes of (1) temperature control, composition adjustment, and the ejection of impurities from the metal up into the slag, (2) the addition of nitrogen gas, and (3) the addition of oxygen for secondary decarburization or temperature adjustment.

Present refractory gas injection pipe lances have three general types of construction which allow a gas to be dispersed in the molten metal: (a) an open single pipe, or plurality of exit pipes, attached to a center pipe which protrude through a refractory lining at the bottom of the lance with direct contact to the metal, (2) a porous body with a performed shape of a permeable refractory matrix (permeability 0.1 to greater than 1.0 $cm^3$-cm/sec-$cm^2$-g/$cm^2$, in many cases) connected to the lower lance pipe center on the side and the bottom, and (3) a metal pipe, a metal tubular pipe, or a conical metal spinning, any of which can contain a porous refractory plug which allows the passage of gases in sufficient quantities so as to produce the desired process control in the metal bath.

During the bubbling or stirring of a molten metal bath in a transport ladle using the above designs, premature failure of the lance tip is very common such that the full useful life of the total lance is not realized. By lance tip, what is meant is the lower 12" to 16" of the submerged end of the pipe lance through which the gases are expelled into the liquid metal bath. The high temperatures, the caustic slag, and the abrasion caused by stirring all tend to combine for a hostile environment for the lance.

With lances which have a single or multiple pipe discharge ports, low gas velocity causes large bubbles which are unable to force the molten metal away from the lance thereby causing accelerated refractory erosion and premature lance tip failure. Further, the melting and collapse of the exit pipes causes rapid deterioration of the pipe lance as the entire gas flow becomes uncontrolled or stopped.

With a porous body having a performed shape of refractory matrix, higher velocity gas discharges are realized than with the pipe method and the gas is ejected in the form of small bubbles over a greater surface area. The higher gas velocity and smaller bubbles are more protective of the lance. However, there are other problems associated with the performed porous body. These systems must discard the good physical properties associated with a low porosity-high density ceramic which is designed for extended submerged contact with liquid steel at temperatures between 2,820° F. to 3,150° F. for their high permeability. The physical properties of the low porosity-high density ceramic, which are sacrificed in this tradeoff are high erosion resistance, high corrosion resistance, high abrasion resistance against the severe molten slag and steel stirring, density, and physical strength. Because of its higher porosity, the porous body has very poor volume stability, and, thus a high shrinkage which causes the porous body to wear quickly and, thus, prematurely.

With a porous plug sheathed within a cylindrical or conical metal casing, various blends of refractory aggregates are used (tubular alumina, calcined alumina, fused alumina, mullite, chromic oxide, chromite, quartz, magnesite, synthetic alumina-silicates, zircon, etc.) to produce a porous plug similar in physical and chemical properties to the porous performed shape. However, the same loss in physical properties occurs in this type of permeable ceramic plug as in the preshaped structure. Premature wear of the porous plug can cause the plug to be blown out of a lance or nozzle refractory wall altogether. This type of failure causes an immediate reduction of gas velocity and consequent accelerated wear and premature failure of the lance tip slide wall above the port which mounts the porous plug.

With these structures, the flow rate of a pipe lance is a direct function of the permeability of the porous refractory body. As indicated in ASTM (American Standard Testing Methods) Part 13, ASTM Designation: C 577-87, "Test Method For The Permeability Of A Refractory" the permeability of a refractory body is proportional to the length of the specimen. Thus, as the lance tip wears and the refractory porous media becomes less thick, the flow rate increases linearly at a constant flow pressure. This activity results in an unbalanced and uncontrolled system because there is no method of readily controlling the rate of erosion or knowing what it is.

Therefore, the prior bubbling refractory pipe lances described do not result in optimum overall useful life of the gas injection refractory pipe lance, due in many cases, to the failure of the lance tip because of the premature failure of metal pipes, a porous plug and/or the surrounding refractory tip material. Furthermore, no flow and low or uncontrolled flow rates are a continuous problem with these lances resulting in the removal of the pipe lance from operation.

SUMMARY OF THE INVENTION

Therefore, it is an object of the present invention to provide an improved gas injection refractory bubbling pipe lance or nozzle for the secondary refinement of a bath of molten metal.

It is a further object of the invention to provide a refractory pipe lance or nozzle which includes a low porosity-high density radial burst refractory plug with apertures that maintain a constant diameter durinmg gas injection under severe conditions.

It is yet another object of the invention to provide a refractory bubbling pipe lance or nozzle which has an optimum overall useful life and an increased longevity for the lance tip.

It is also an object of the invention to provide a refractory bubbling pipe lance or nozzle with at least one low porosity-high density radial burst refractory plug, preferably a conical plug, having arcuate apertures therein and to provide the method of making such plug.

In accordance with the present invention, a highly improved gas injection refractory bubbling lance or nozzle has been provided for injecting Argon gas or other gases under pressure ranging from 35 psi to 300 psi in 200 ton steel transport ladles at depths of 12 feet or deeper. Such metallurgical apparatus have increased lifetimes and are much less prone to catastrophic failure than those of previous design.

In a preferred implementation, the pipe lance includes an elongated wire reinforced (1% by weight or higher) refractory body having a central metal tube forming a substantially central bore for the refractory body. The central tube has at least one low porosity-high density refractory plug containing one or more constant diameter nozzle apertures. The plugs are securely attached to the central tube and communicate pressurized gas from the central bore to the outside surface of the refractory body. The refractory body is formed by vibration casting a wire reinforced refractory material over the central tube and high density refractory plug skeleton.

The fabrication of the high density refractory plug includes either a cylindrical or conical ceramic body manufactured from a number of commercially available ceramic compositions. Preferably, high alumina castables, low cement castables, no cement castables, or phosphate bonded ramming mixes can be used. A preferred refractory matrix includes by weight 94% alumina, 3% chromic oxide, and the remainder being a binder and impurities. A preferred binder material is calcium aluminate cement. Alternatively, a pressed and sintered ceramic body of similar materials can be used.

The common ceramic characteristics desired of the inventive refractory plug are the properties of low porosity and low shrinkage with optimum strength and high density. These properties protect the plug from the hostile environment of the transport ladle and allow the apertures in the plug to maintain a constant diameter through the useful life of the plug. The ceramic plug is contained within a thin metal shell and contains a plurality of apertures of constant diameter substantially equally distributed across the face of the refractory plug which is in contact with the liquid metal. Preferably, the apertures about the periphery of the plug are arcuate in shape. The apertures may be cut, drilled, cast, pressed, or by some other suitable method, formed in the ceramic plug.

In all the conical sheathed plugs of the present invention, all appertures around the perimeter of the metal conical casing are formed in an arc with a radial curvature which disperses ejected gases in a substantially radial burst. This is particularly effective when the gas is blown straight down into the ladle bottom, the most commonly used method in the United States. It is pointed out that one cubic foot of gas can produce 13.5 million bubbles of one-sixteenth inch diameter with 1,150 SF area/CF.

Preferably, the apertures are formed prior to the setting of the refractory by mounting thermally expansive rods with a jig in the desired locations of the holes. A high alumina, ultra low cement (0.5% CaO) castable refractory, enriched with chromic oxide (1%–18%) is subsequently poured into the casting shell and homogenized with high frequency vibration. The rods are then heated to expand against the refractory matrix and set it, thereby forming apertures of a desired size. After the refractory has set, the rods are allowed to cool and contract so that they can be removed easily. While steel or aluminum or other metal rods can be used, it is preferred to use bronze rods with a thermal expansion coefficient nearly three times that of the refractory matrix. The bronze rods are used in the illustrated implementation because the refractory will not wet the bronze and are not adversely affected by common ceramic binders. The method produces metering apertures of a constant size which are smooth and can be reproduced to small tolerances.

Upon completion of the fabrication of the low porosity-high density refractory plug with an external metal casing or shell, the plug is welded or by some other known suitable means, attached to the central tube to become an integral part of a skeleton for forming the refractory body which forms an outer liner. Such lances in service have an extended lance tip life, thereby extending the total life of the pipe lance. Plug failures such as in high porosity porous plug type lances have been eliminated from this type of system.

The present invention provides an improved unique pipe lance having an externally shielded, low porosity, dense, and thermal shock resistant refractory plug with apertures of constant diameter, preferably a conical plug with arcuate apertures. The advantages of a pipe lance constructed in accordance with the invention include the selection of the refractory material for the low porosity-high density plug independent from the selection of the material for the refractory body. Thus, a better grade of ceramic which is denser, of a lower porosity, and of higher corrosion resistance may be used. With independently manufactured low porosity-high density refractory plugs, the steel or carbon reinforcing fibers usually found in a refractory outer liner may be eliminated, if desired, thereby increasing the slag resistance of the plugs. Additional or secondary processing steps may be taken to enhance the physical properties of the refractory plugs, including sintering or high temperature firing of the plugs. For vibratory casting of the refractory outer liner, the metal shield allows the plug to function as a structural connection and as a structural brace during manufacture and, in service, a metallic anchoring means.

Because the apertures in the ceramic are not metal lined, they always remain a constant diameter with no partial interwall melt-out while in operation. Protective small gas bubbles with a high gas velocity are available over the lifetime of the metallurgical processing apparatus. Therefore, even as progressive wear proceeds during the useful life of the pipe lance, the gas flow rate will remain constant within a closed system.

These and other objects, features, and aspects of the invention will become clearer and more fully detailed when the following detailed description is read in conjunction with the appended drawings.

BRIEF DESCRIPTION OF THE DRAWINGS

FIG. 1 is a cross-sectional side view of a low porosity-high density refractory plug of cylindrical design constructed in accordance with the invention;

FIG. 2 is a front end view of the low porosity-high density refractory plug illustrated in FIG. 1;

FIG. 3 is a quarter-sectioned perspective view of a low porosity-high density refractory plug of conical design constructed in accordance with the invention;

FIG. 4 is a representative block diagram of a preferred method for manufacturing the low porosity-high density refractory plugs illustrated in FIGS. 1-3;

DETAILED DESCRIPTION OF THE PREFERRED EMBODIMENT

Figure 5:
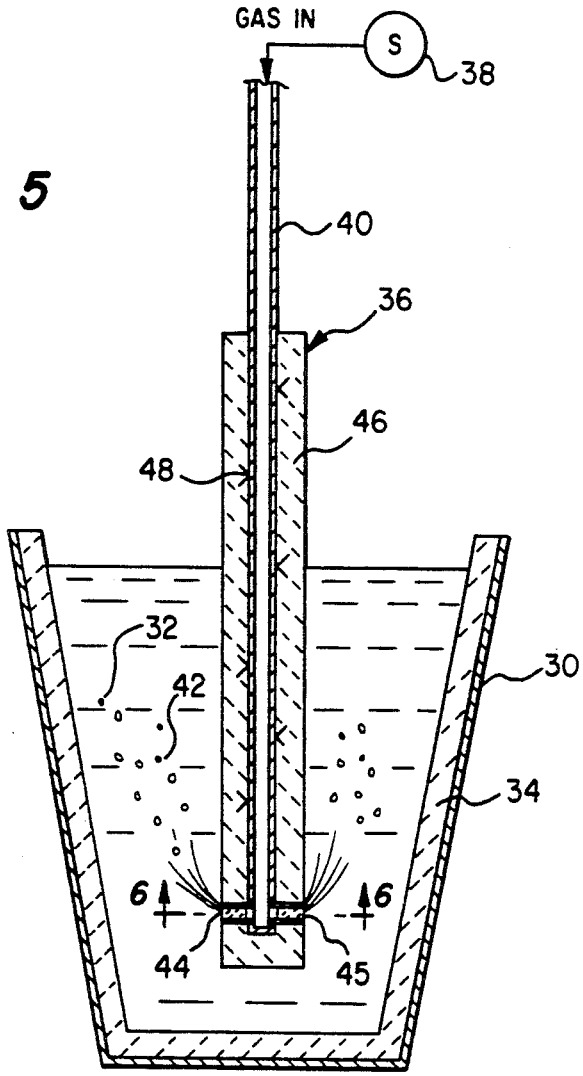
FIG. 5 is a cross-sectional side view of a transport ladle filled with molten steel having a refractory pipe lance constructed in accordance with the invention inserted therein.

FIGS. 1 and 2 illustrate a low porosity-high density refractory plug 10 constructed in accordance with the invention. The plug, in a first embodiment, is made from a high density refractory material 12 formed into a generally cylindrical shape. The plug utilizes one or more constant diameter nozzle apertures or holes 14 to provide a constant gas flow rate. If the plug 10 has only one aperture then it is centered; while if the plug has more than one, the plurality of apertures is evenly distributed around the plug. The apertures 14 are formed generally parallel to the longitudinal axis 16 of the plug 10 and run from an input end 20 to an output end 22 to convey gases under pressure from one end of the plug to the other. An outer metal shell 18 is formed around the plug 10 to act as a structural, casting, and operational support member.

Figure 15:
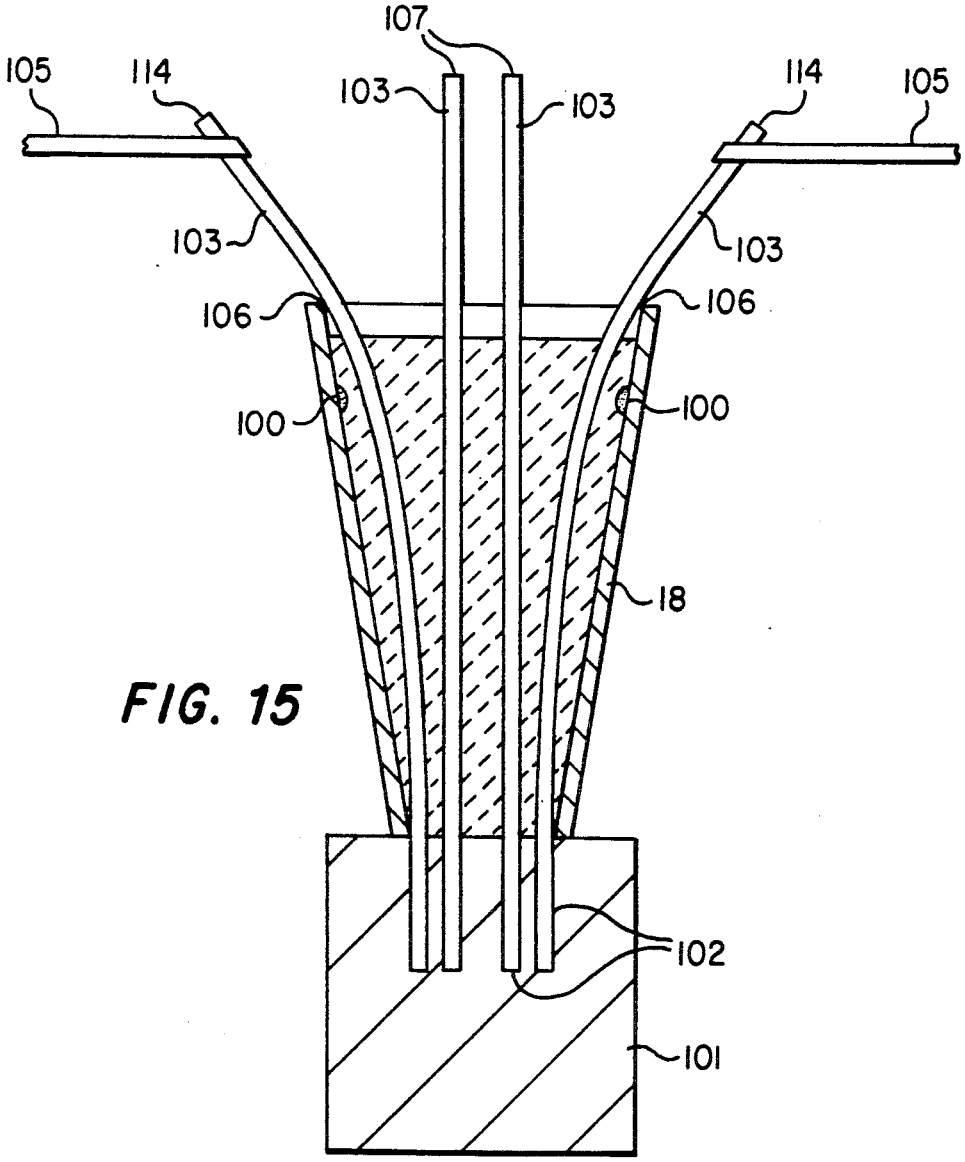
FIG. 15 is a cross-sectional view of a jig and thermally expansive rod procedure used to make the refractory plug of FIG. 14.

Another preferred embodiment of the low porosity-high density refractory plug 10 is illustrated in FIGS. 3 and 15 where a conically shaped plug is shown to advantage. The conical embodiment of FIG. 3 similarly contains one or more apertures 14 in the refractory material of the plug 10 and has a metal shall 18. The input end 20 of the conical plug 10 is larger in cross section than its output end 22 to produce a keying effect when mounted in a pressurized metallurgical process apparatus. The conical shaped plug of FIG. 15 with arcuate apertures is described below.

A method of manufacture of the embodiments shown in FIGS. 1-3 will now be more fully disclosed with reference to FIG. 4 which is a detailed flow chart of the preferred process steps for forming a low porosity-high density refractory plug with constant flow characteristics. In step A10 a casing form is provided which preferably is the metal shell 18 of the plug. Thermally expansive rods are then located in the casting cavity of the form with a jig to lie parallel to the longitudinal axis of the form where the apertures are to be located in step A12. The form is then filled with a castable refractory and vibrated to expunge the air and fill in all the spaces around the rods evenly in steps A14 and A16. The rods are preferably of a bronze composition of 60% copper and 40% zinc which has a thermal expansion coefficient, $10.0\times10^{-6}/°$ F., nearly three times that of most ceramics. The rods are heated to set the refractory material in step A18 causing an expansion of the rods to the desired aperture size. This can be accomplished by a number of methods, but most conveniently is done by forcing high velocity hot air, about 130°-180° F., across the top of the rods which conducts the heat down through the rest of the rod. This method has the advantage of drying the refractory around the rods and setting the surrounding material which will become the apertures. Further, above 95° F., the refractory binder of calcium aluminate cement will set up into a higher density and corrosion resistant phase. After the refractory has set, the rods are allowed to cool and contract away from the sides of the apertures so that they can be easily removed in step A20. The plug is then allowed to dry thoroughly by being low fired, typically at 600° to 700° F.

Using bronze rods has the additional advantage in that the castable refractory compounds tend not to corrode or wet this metal and that common binders do not adversely react with it so that when the contraction takes place, a smooth bore wall for the apertures results. Because the initial size of the rods can be controlled precisely and the heating well regulated, the sizes of the bores in the refractory material can be produced within a small range of tolerances. This will produce a constant flow rate of gas under a constant pressure for a well regulated process. These apertures also produce small protective bubbles at a relatively high gas velocity across the plug face.

If a single aperture is to be formed, its diameter is preferably between 0.10 inches and 1.25 inches. If a plurality of apertures is to be formed, their diameter are preferably between 0.01 inch and 0.55 inch, or larger if a powder injection system is used. The apertures are for plugs within a range of 1.25 inches in diameter by 3.75-4.0 inches in length or 1.875 inches in diameter by 7–8 inches in length. With typical gas pressures and flow rates for pipe lances, it is believed that these nozzle apertures produce Reynolds Numbers on the order of 100,000.

Furthermore, both the 4 inch and 8 inch long plug described above contain 57% radial holes surrounding the perimeter of the metal casing and all are formed radially with a radius of approximately 24 inches to 36 inches and 60 inches to 72 inches, respectively. Optimum hole diameter is 1/16 inches (1.6 mm) with an approximate range of ⅛ inch to 3/64 inch (3.2 mm to 1.2 mm). Twenty (20) inch long holes have been easily produced.

In addition, the optimum range of conical sidewall taper of the metal spinning is 7½ degrees and 3 degrees, respectively, and therefore does not lend itself to threading and, therefore, a totally welded construction is used.

The fabrication of the low porosity-high density refractory plug includes either a cylindrical or conical ceramic body manufactured from a number of commercially available ceramic compositions. Preferably, high alumina castables, low cement castables, no cement castables, or phosphate bonded ramming mixes can be used. A preferred refractory matrix includes by weight about 94% alumina, about 3% chromic oxide, and the remainder being a binder and impurities. A preferred binder material is calcium aluminate cement. Alternatively, a pressed and sintered ceramic body of similar materials can be used.

The common ceramic characteristics desired of the low porosity-high density refractory plug are the properties of low porosity and low shrinkage with optimum strength and high density. Normally, high porosity plugs have a porosity factor between 18–35% which is too high to provide optimum protection. With the low cement castables described herein, plugs having densities of 160–190 lbs./ft$^3$, porosities of 10–14%, and melting temperatures in excess of 3,000° F. can be obtained. These properties protect the plug from the hostile environment of the transport ladle and allow the apertures in the plug to maintain a constant diameter through the useful life of the plug. Also, these properties enhance the thermal shock resistance of the plug. The ceramic plug is contained within a thin metal shell and contains a plurality of apertures of constant diameter substantially equally distributed across the face of the refractory plug which is in contact with the liquid metal.

The advantages of a plug formed in this manner include secondary processing steps, such as step A24, which can be accomplished. Sintering to improve the corrosion characteristics or other treatments can be used which are not easily applicable to an entire pyrometallurgical apparatus, such as a pipe lance.

The low porosity-high density refractory plug has many uses, particularly in metallurgical process apparatus, such as a pipe lance. FIG. 5 shows a cross-section through a casting ladle 30 of liquid steel 32 lined with refractory 34. A pipe lance 36 is used for the secondary refinement of the metal by the injection of gases under pressure from a source 38. The pipe lance 36 comprises a tubular pipe center 40 through which gases 42 are injected into metal bath 32 through one or more high density refractory plugs 44 and 45.

The pipe lance 36 in the figure is made by structurally attaching at least one high density refractory plug 44 to the center pipe 40. The center pipe 40 and plug 44 form a skeletal structure which is then placed in a container and a refractory material for an outer liner 46 cast around the inner structure. The refractory outer liner 46 can be anchored to the center pipe 40 by V-shaped anchor pins 48 which are welded to the pipe prior to casting. The outer liner 46, further, is usually reinforced with 1%–6% stainless steel or carbon steel fibers for strength. The fibers are susceptible to the highly caustic slag and may melt out at the tip of the lance. The outer refractory linear 46 can be alumina-silicate refractory material or basic aggregate mixes (various sized blends of tubular alumina, calcined alumina, fused alumina, bauxite, mullite, chromic oxide, chromite, quartz, magnesite, synthetic alumina silicates, zircon, etc.) and utilize conventional refractory bonding systems such as calcium aluminate cement, sodium/potassium silicates, chromic acid, phosphoric acid, sulfanilic acid, resins, etc.

Figure 6:
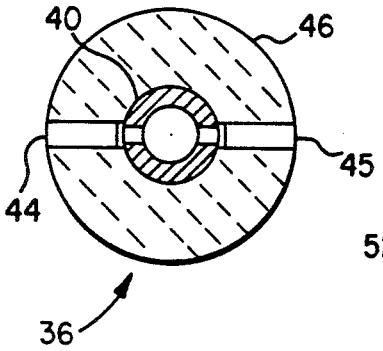
FIG. 6 is a cross-sectional view of a first embodiment of the pipe lance illustrated in FIG. 5. taken along section line 6—6.
Figure 7:
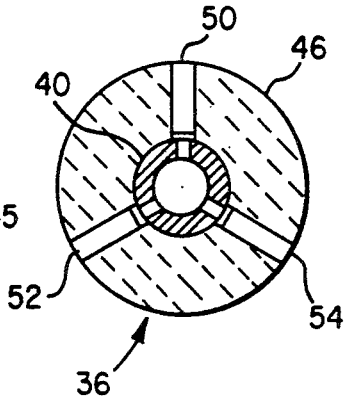
FIG. 7 is a cross-sectional view of a second embodiment of a pipe lance similar to that illustrated in FIG. 5.
Figure 8:
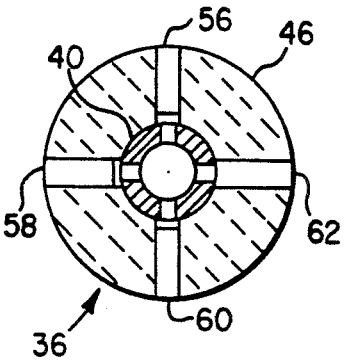
FIG. 8 is a cross-sectional view of a third embodiment of a pipe lance similar to that illustrated in FIG. 5.

FIGS. 6, 7, and 8 show cross-sectional views of three arrangements of low porosity-high density refractory plugs advantageously used in pipe lances. High density plugs 44, 45 are attached to the lance pipe center 40 at the lance tip and encompassed in protective refractory liner 46 of the lance pipe 36. In the two plug lance 36 of FIG. 6, the plugs 44, 45 at the lance tip are substantially in the same plane and separated by 180° increments. In the three plug lance 36 of FIG. 7, the plugs 50, 52, and 54 at the lance tip are substantially in the same plane 120° apart. In the four plug lance 38 of FIG. 8, the plugs 56, 58, 60 and 62 at the lance tip are substantially in the same plan 90° apart.

A very important structural consideration for the pipe lance 36 is that a low porosity-high density refractory plug does not become displaced during operation. Displacement results in a catastrophic failure of the lance as the gas stops flowing through the nozzle apertures to make protective bubbles and the gas rate is totally uncontrolled. This also will cause a rapid erosion of the lance tip refractory outer liner 46. The invention provides a means for securing the high density refractory plugs to the center tube 40 to prevent such consequences. As better seen in FIG. 9, a cylindrical high density refractory plug, for example 45, is provided with a steel collar 70 at its input end 20. The collar 70 can be fixed to the plug in a number of ways, but preferably is welded onto the metal shield 18 with a 360° weld 72 to the step between the shield and the collar. The collar 70 is then inserted into a hole cut into the central tube 40 and welded by a 360° weld 76 to the step between the collar and the outside surface of the tube 40. The collar 70 is about the same thickness as the center tube 40 and slightly longer in length to provide the stepped structure seen in the figure. The double welds at 72 and 76 provide a convenient and advantageous method for securely fixing the plug 45 to the central tube 40 of the pipe lance 36 and solves the problem of attaching the relatively thin walled shell 18 to the relatively thick walled tube 40. With this method the shell 18 can be made much thinner and thus be more resistant to melt-out to protect against consequent loss of the plug 46.

Another feature which increases the longevity of the high density refractory plug 46 is the addition of several anchor means, illustrated as metal screws 78. The metal screws 78 are mounted prior to casting of the plug by inserting them through the shield 18. The casting of the high density ceramic 12 and the outer liner 46 are then accomplished as indicated previously. The screws 78 and particularly their shape, relatively conical with large screw threads, anchor the shield 18 securely to the high density ceramic 12 and to the refractory outer liner 46.

Figure 9:
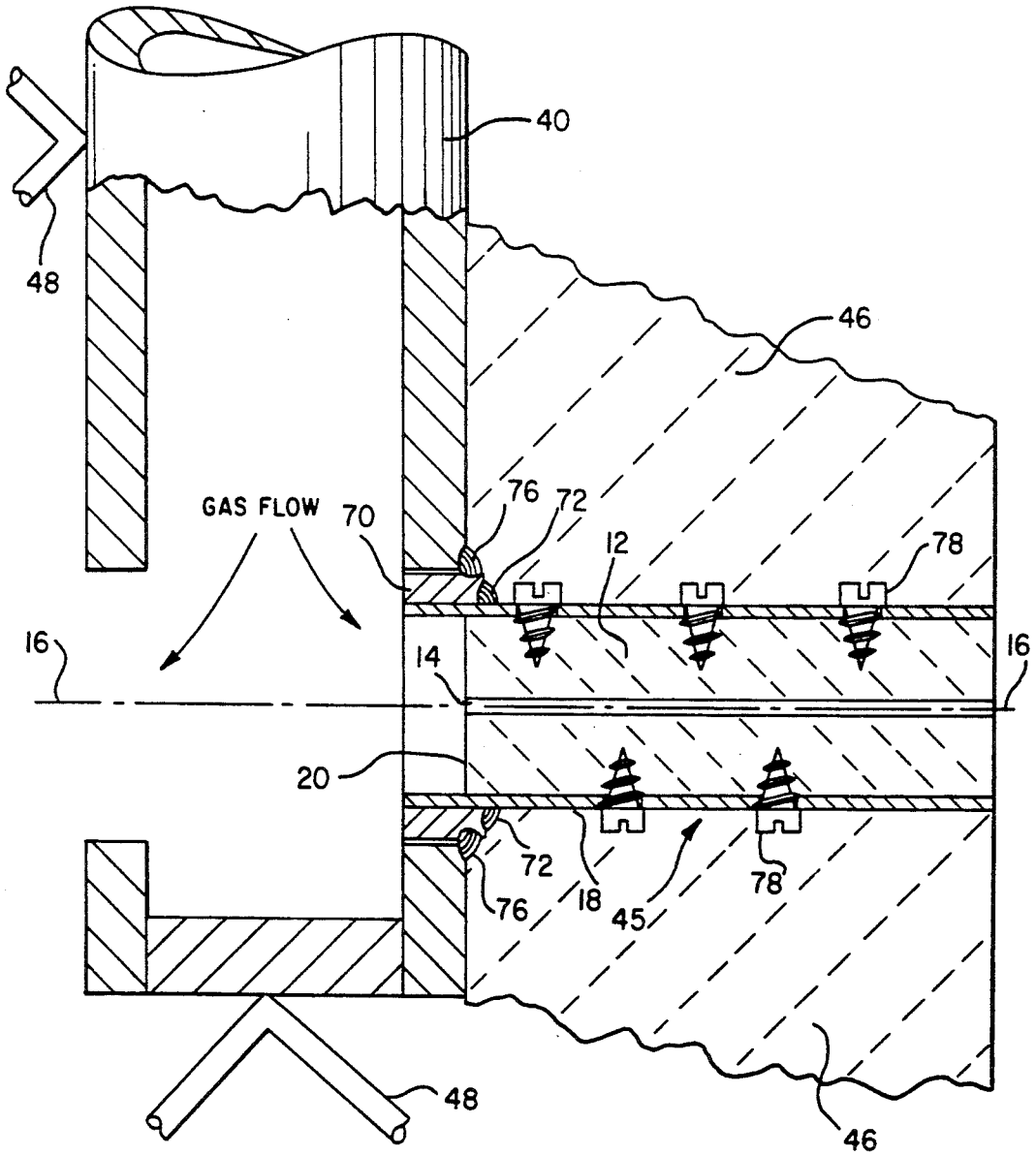
FIG. 9 is a partially fragmented and partially cross-sectioned side view of the pipe lance tip for the pipe lance illustrated in FIG. 5 disclosing the connection of a low porosity-high density refractory plug to the center tube of the lance.

It is evident that the collar 70 and anchor means 78 can be used on other embodiments of the invention. The high density plug shown in FIG. 9 is illustrative and not limiting. The collar 70 and anchor means 78 can be used with the conical embodiment (FIG. 3) of the plug and a pipe lance 36 which mounts such plugs parallel, perpendicular, or oblique to the longitudinal axis of the lance.

Figure 10:
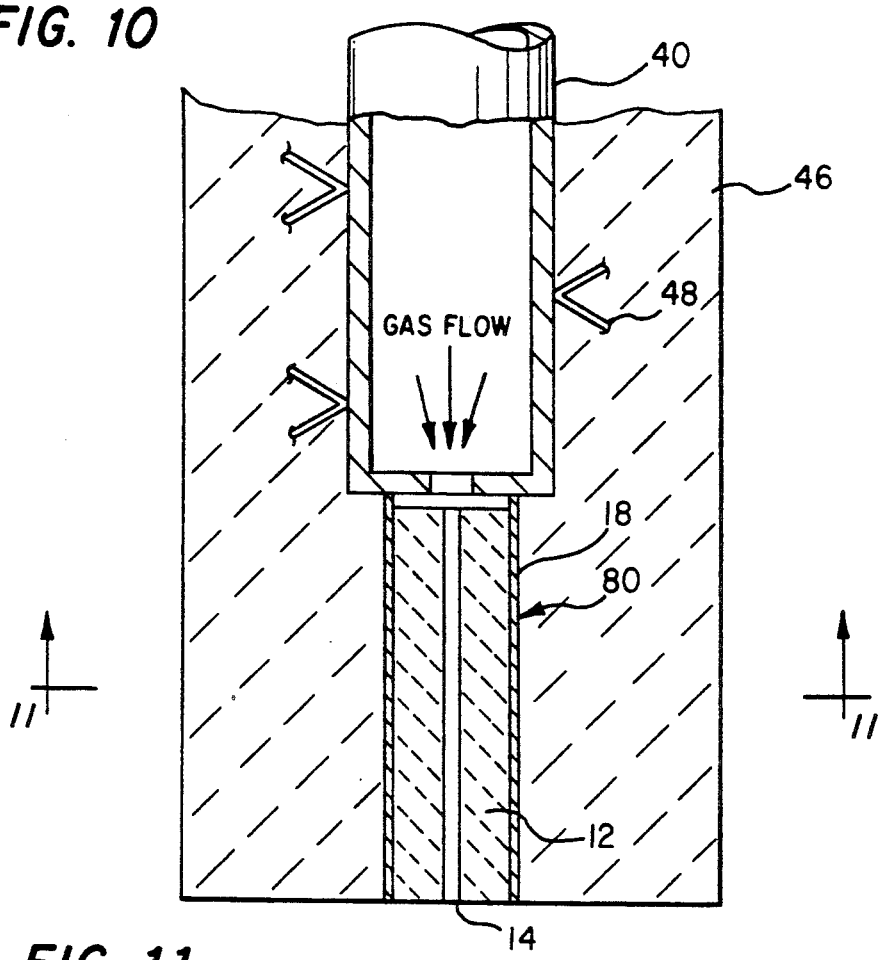
FIG. 10 is a partially sectioned and partially fragmented side view of another embodiment of a refractory pipe lance constructed in accordance with the invention.
Figure 11:
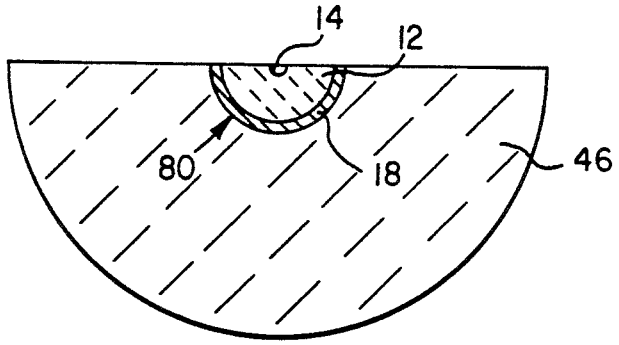
FIG. 11 is a half cross-sectional end view of a first embodiment of the pipe lance illustrated in FIG. 10 taken along section line 11—11.
Figure 12:
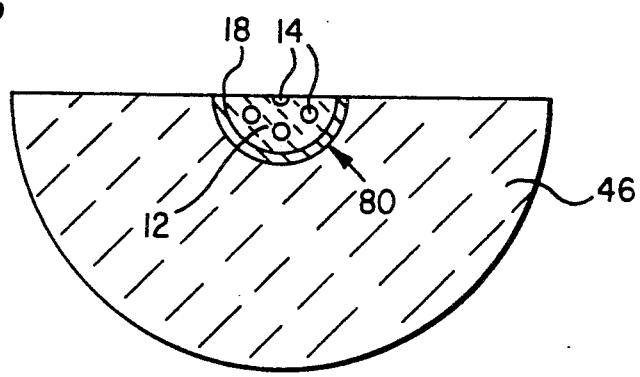
FIG. 12 is a half cross-sectional end view of a second embodiment of a pipe lance similar to that illustrated in FIG. 10.

FIG. 10 shows a cross-sectional side view of another embodiment of a refractory pipe lance with a single low porosity-high density refractory plug 80 securely attached to the structural center pipe 40 and encompassed within refractory outer liner 46. In this implementation, the high density refractory plug 80 is mounted parallel to the longitudinal axis of the center tube 40 and produces bubbles which are ejected downwardly into the molten metal and then flow up and around the pipe lance tip to reduce erosion of the refractory outer liner 46. FIGS. 11 and 12 show half sections of a lance tip according to this embodiment having a high density plug 80 with a single aperture 14 and a plurality of apertures 14, respectively. Moreover, it is evident that the high density refractory plugs can also be mounted obliquely to the axis of the center pipe 40.

Figure 13:
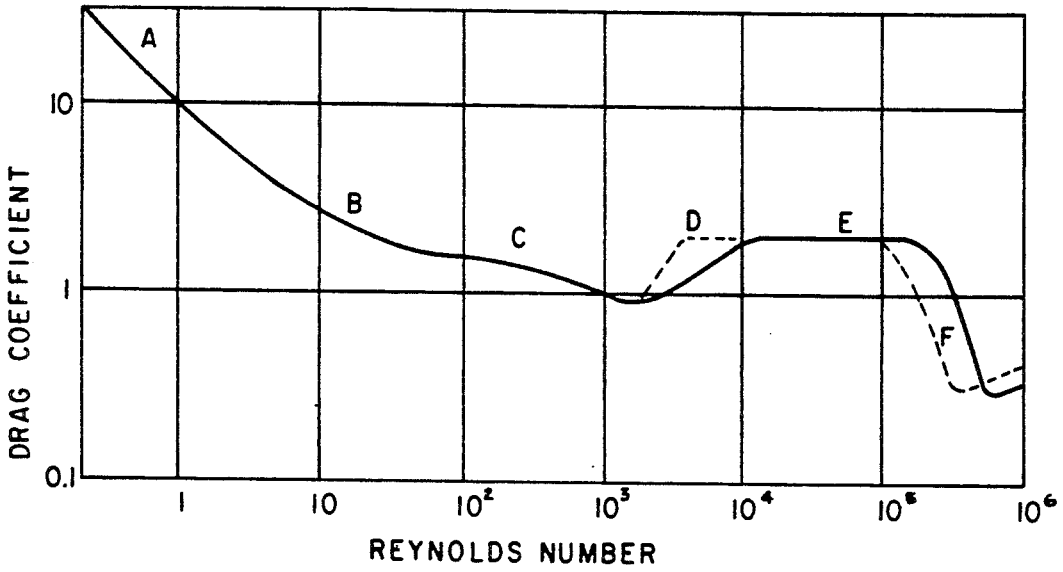
FIG. 13 is a graphical representation of the drag coefficient representing force as a function of Reynolds Number representing gas velocity for an infinitely long cylinder representing the pipe lances illustrated in FIGS. 5-11.

Extended pipe lance wear has been developed through the design of the low porosity-high density refractory plug with constant flow characteristics which is incorporated into the pipe lance refractory outer liner. The total force of the liquid metal against the generally cylindrical refractory pipe lance is reduced by accelerating the exit gases through the maintainable constant flow apertures resulting in significantly longer pipe lance life. FIG. 13 shows the relationship between the drag coefficient exerted against a cylindrical wall of infinite length as a function of the exponential increase in Reynolds Number, UD/v, where D=cylinder diameter; U=speed; and v=kinematic viscosity of the gas or liquid encompassing the cylinder. The lance is representative of the cylinder and the drag coefficient is representative of the force on the lance in a molten metal environment. The graph therefore predicts that if the Reynolds Number is increased by increasing and maintaining injection gas velocity, then the force seen by the pipe lance will be significantly reduced, thereby producing less erosion of the outer liner and increasing the lifetime of the lance.

Figure 14:
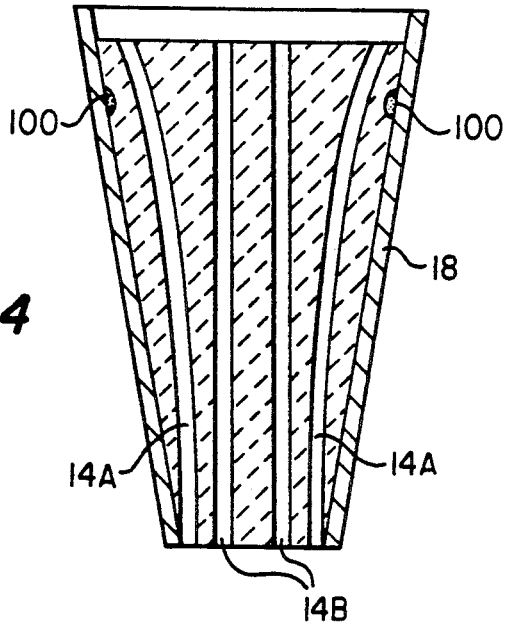
FIG. 14 is a cross-sectional view of a low porosity-high density refractory plug of conical design having arcuate peripheral apertures constructed in accordance with the invention.

FIGS. 14 and 15 illustrate the preferred plug of the present invention and its method of manufacture and in which the reference numerals for the elements of the plug are the same as those used for FIG. 3. In addition, the plug of FIG. 14 contains an interior weld 100 which extend in a continuous 360° circle in the interior of conical metal shell 18. The apertures 14A at the outer perimeter of the plug are arcuate while interior apertures 14B are straight. However, interior apertures 14B can be curved in a direction opposite the curvature of perimeter apertures 14A; convexed and concaved.

The arcuate apertures enable the gas bubbles to be dispersed over a wider area in the steel; a radial burst of bubbles. This minimizes any ability of the bubbles from various apertures to combine to form larger bubbles and therey slow down the reaction time required to form the steel.

The method of making plugs with arcuate apertures is illustrated in FIG. 15. Shown therein is jig 101 made of wood or metal onto which conical metal shell 18 is placed and firmly held by means not shown, but which are conventional, such as clamps. Jig 101 contains openings 102 into which are placed thermally expansive rods 103. After filling the conical metal shell to the desired level with the castable refractory and proceeding as set forth above in forming the plug of FIG. 3, rods 103 that are to form the arcuate apertures at the perimeter of the plug have a removable pressure applied to the upper ends 114 thereof and the casing is filled with refractory., The tops of rods 103 are then heated. Rods 103 are sufficiently flexible so that they bend evenly to form a substantially uniform arc shape without breaking. Further the length of the aperture arcs formed is short enough that after the refractory material has been sufficiently set and the rods are allowed to cool, the expanded rods contract to their original diameter and can be readily removed from the apertures after the distorting pressure is removed. Conveniently, the pressure to bend the peripheral rods can be applied by elastic bands 105 which are looped about the upper ends 114 of rods 103 and attached to support surfaces (not shown). It has been found with the sizes and shapes of conical plugs discussed above that the force required to bend the peripheral rods until they touch the upper end 106 of metal shell 18 is adequate to give the arcuate shape desired.

If it is desired to have the interior apertures curved in an opposite direction to that of the perimeter apertures as discussed above, this can be accomplished by applying a removable pressure to the upper ends 107 of such rods to bend them toward the center line of the conical shell 18. Means such as a wire about all of the interior rods forcing them to bend towards each other will give the desired curvature, keeping in mind that the bottoms of all of rods 103 are rigidly held in place in openings 102 in jig 101 making it a simple matter to bend the thin rods 103 to form the desired acuate apertures in both the perimeter and interior of the plug.

While preferred embodiments of the invention have been shown and described in detail, it will be obvious to those skilled in the art that various modifications and changes may be made thereto without departing from the spirit and scope of the invention as is defined in the appended claims.

What is claimed is:

1. A refractory pipe lance comprising:

a lance center pipe having an external refractory liner with at least one opening in said refractory liner corresponding with at least one opening in said lance center pipe, and at least one plug comprising a metal shell having a low porosity-high density refractory within said shell and containing a plurality of apertures in said refractory, each of said apertures having a substantial uniform diameter between about 0.01 to 0.55 inch, said plurality of apertures comprising arcuate apertures at least about the outer perimeter of said plug, said at least one plug being affixed securely to said center pipe at said at least one opening in said pipe and extending therefrom through said corresponding at least one opening in said refractory body, whereby at least one continuous open pathway is provided from said lance center pipe and through said at least one opening in said lance pipe and said plurality of apertures in said at least one plug to the exterior of said pipe lance.

2. A refractory pipe lance for the injection of pressurized gas into a molten metal bath, said pipe lance comprising:

an elongated refractory body;

a tube forming a central bore through said refractory body;

at least one plug securely attached to said tube and transversing the refractory body from said tube to an outside surface of the refractory body;

said at least one plug comprising a metal shell and a low porosity-high density refractory within said shell and said refractory containing a plurality of nozzle apertures of a constant diameter for communication of a pressurized gas from said central bore to said outside surface of said refractory body, said plurality of apertures comprising arcuate apertures at least about the outer perimeter of said plug.

3. A refractory pipe lance as set forth in claim 2 wherein:

said plug and shell are substantially cylindrical.

4. A refractory pipe lance as set forth in claim 2 wherein:

said plug and shell are substantially conical.

5. A refractory pipe lance as set forth in claim 3 wherein:

said plug has a plurality of said nozzle apertures substantially equally distributed about the longitudinal axis of the plug.

6. A refractory pipe lance as set forth in claim 5 wherein:

said nozzle apertures are between about 0.01 inches and about 0.55 inches in diameter.

7. A refractory pipe lance as set forth in claim 2 wherein:

said at least one low porosity-high density refractory plug is disposed parallel to the longitudinal axis of the pipe lance.

8. A refractory pipe lance as set forth in claim 2 wherein:

said at least one low porosity-high density refractory plug is disposed perpendicularly to the longitudinal axis of the pipe lance.

9. A refractory pipe lance as set forth in claim 8 including:

two low porosity-high density refractory plugs located substantially in the same plane and separated by 180° increments.

10. A refractory pipe lance as set forth in claim 9 including:

three low porosity-high density refractory plugs located substantially in the same plane and separated by 120° increments.

11. A refractory pipe lance as set forth in claim 8 including:

four low porosity-high density refractory plugs located substantially in the same plane and separated by 90° increments.

12. A refractory pipe lance as set forth in claim 3 wherein:

said at least one low porosity-high density refractory plug includes a substantially tubular collar fixed to a plug end that is securely fixed to said central tube.

13. A refractory pipe lance as set forth in claim 12 wherein:

said collar has a thickness substantially equal to the thickness of said central tube.

14. A refractory pipe lance as set forth in claim 13 wherein:

said collar has a length slightly longer than its thickness thereby producing a stepped edge when inserted into an aperture of said central tube.

* * * * *